US007057359B2

(12) United States Patent
Hung et al.

(10) Patent No.: US 7,057,359 B2
(45) Date of Patent: Jun. 6, 2006

(54) METHOD AND APPARATUS FOR CONTROLLING DRIVING CURRENT OF ILLUMINATION SOURCE IN A DISPLAY SYSTEM

(75) Inventors: Ghi-Mao Hung, Chiayi (TW); I-Hsin Lo, Taichung County (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

(21) Appl. No.: 10/695,592

(22) Filed: Oct. 28, 2003

(65) Prior Publication Data

US 2005/0093488 A1 May 5, 2005

(51) Int. Cl.
*G09G 3/36* (2006.01)

(52) U.S. Cl. ..... 315/291; 345/104

(58) Field of Classification Search ..... 315/149–159, 315/291, 307, 308, 169.3, 247, 312, 314, 315/316, 318, 224; 345/611, 39, 63, 48–50, 345/87–89, 104

See application file for complete search history.

(56) References Cited

U.S. PATENT DOCUMENTS

| | | | | |
|---|---|---|---|---|
| 5,036,251 | A * | 7/1991 | Lee | 315/10 |
| 6,265,833 | B1 * | 7/2001 | Kim et al. | 315/149 |
| 6,563,511 | B1 * | 5/2003 | Yeh et al. | 345/611 |
| 6,690,121 | B1 * | 2/2004 | Weindorf | 315/291 |
| 6,801,003 | B1 * | 10/2004 | Schanberger et al. | 315/291 |
| 6,897,624 | B1 * | 5/2005 | Lys et al. | 315/297 |

* cited by examiner

*Primary Examiner*—Wilson Lee
(74) *Attorney, Agent, or Firm*—Baker & McKenzie LLP

(57) ABSTRACT

The present application describes a programmable current controller for regulating an operating driving current flowing through an illumination source. The driving current is regulated according to a digital reference corresponding to a predetermined operating current for the illumination source. The digital reference can be converted into a reference electrical parameter (current or voltage). The reference electrical parameter is compared with an operating electrical parameter (current or voltage) corresponding to the operating driving current of the illumination source. Based on the comparison, a driving bias current is generated, which is used to regulate the operating driving current of the illumination source.

16 Claims, 4 Drawing Sheets

METHOD AND APPARATUS FOR CONTROLLING DRIVING CURRENT OF ILLUMINATION SOURCE IN A DISPLAY SYSTEM

FIELD OF THE INVENTION

The present invention relates generally to current regulators and, more particularly, to a programmable current regulator for an illumination source in a liquid crystal display system.

DESCRIPTION OF THE RELATED ART

Generally, Liquid Crystal Display ("LCD") devices are used in various applications such as laptop computers, cellular phones, personal digital assistants, control panels of vehicles, and the like. Typically, an illumination source is placed behind a light modulator, such as a liquid crystal layer, in an LCD device to facilitate image visualization and produce optimal illumination. The illumination source can be a fluorescent lamp, an electroluminescent device, a light-emitting diode (LED), a gaseous discharge lamp, or the like. Typically, a control circuit provides regulated current to the illumination source.

FIG. 1 illustrates a prior art implementation of a current regulator 100 for an illumination source module 104. The illumination source 104 can be placed behind a light modulator in an LCD device. The illumination source module 104 includes serially connected light-emitting diodes (LEDs). An LED current control integrated circuit ("controller") 102 controls the driving current for the illumination source module 104. An output terminal DRV of the controller 102 is connected via an RC filter 106 to the base of a transistor 108. The collector of the transistor 108 is connected via a collector load resistor 110 to a power supply $V_{cc}$. The emitter of the transistor 108 is grounded. The collector of the transistor 108 is further connected via a diode 112 to the illumination source module 104. The output terminal of the illumination source module 104 is grounded via a bias resistor 114. The output terminal of the illumination source module 104 is also connected to a terminal FB of the controller 102. A capacitor 116 couples the power supply Vcc to the ground. Another capacitor 118 couples the diode 112 to the ground.

In the prior art current regulator 100, the bias resistor 114 determines the value of the driving current that can flow through the illumination source module 104. The controller 102 outputs a fixed activation signal through the RC filter 106 to the base of the transistor 108. The transistor 108 provides a predetermined driving current to the illumination source module 104. Typically, once the resistance value of the bias resistor 114 is established, the driving current through the illumination source module 104 cannot be adjusted. The brightness of the LEDs in the illumination source module 104 is proportional to the driving current flowing through the illumination source module 104. A long-term use of circuit components can cause an unexpected variation in the driving current of the illumination source module 104. Further, the driving current in certain types of LEDs, such as Organic LEDs (OLED), can change due to a change in the operating temperature of the current regulator 100. As a result, the brightness of the LEDs in the illumination source module 104 can be adversely affected. Therefore, a need exists in the art for a method and an apparatus for controlling the driving current for illumination source modules in LCD systems.

SUMMARY

The present application describes a system and method for providing a regulated driving current for an illumination source. The illumination source can include a backlight source used in an LCD system such as an LED backlight source used in small LCD systems. The LED backlight source can include various types of LEDs such as, for example, white LEDs, color LEDs, organic LEDs (OLEDs), and the like. In one embodiment, a current regulator provides a regulated operating driving current for the illumination source. A predetermined reference driving current is programmed as a digital reference in a memory. The digital reference is converted into a corresponding first electrical parameter (voltage or current). A comparator compares the first electrical parameter with a second electrical parameter (voltage or current) corresponding to the operating driving current flowing through the illumination source. Based on the comparison, the comparator generates a bias driving current for the current regulator. The current regulator then adjusts the operating driving current for the illumination source accordingly. The current regulator provides a substantially constant operating driving current to the illumination source under various environmental and operating conditions.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

DETAILED DESCRIPTION OF THE EMBODIMENTS

Figure 1:
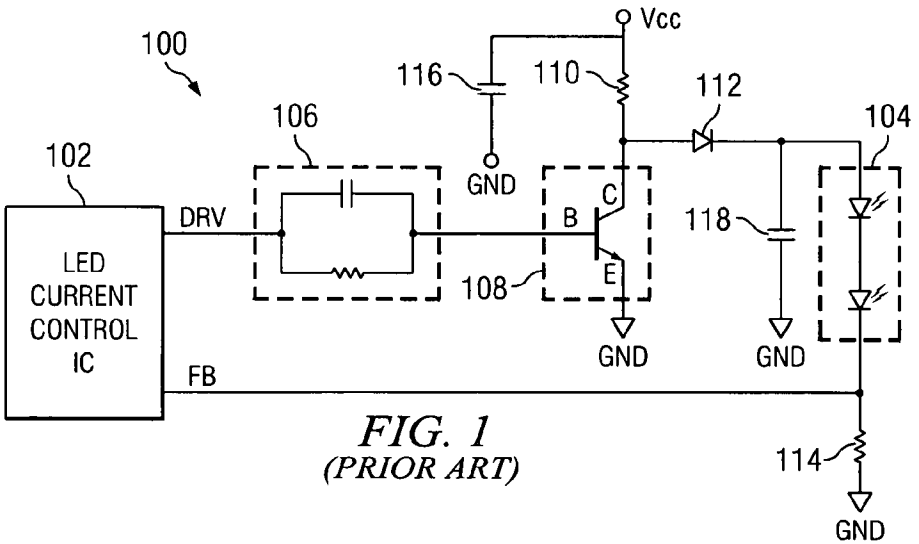
FIG. 1 (PRIOR ART)
FIG. 1 is a schematic view illustrating a prior art circuit implementation of a driving current controller for an illumination source.
Figure 2A:
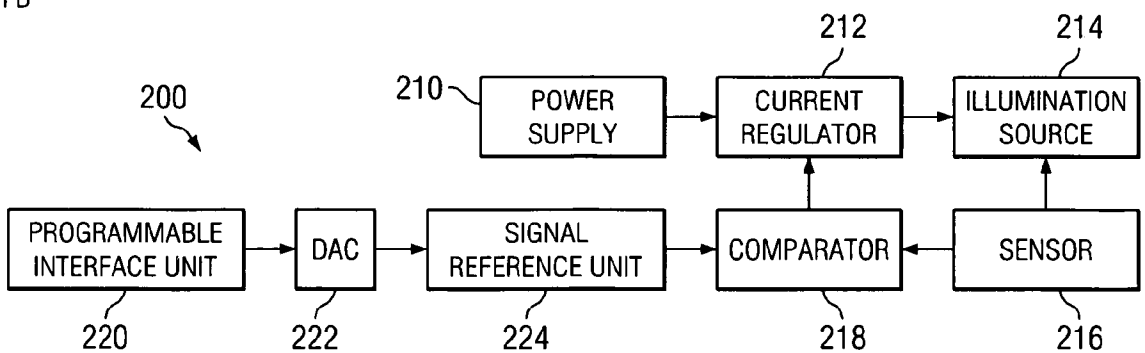
FIG. 2A is an exemplary block diagram of a controller configured to provide programmable regulated driving current for an illumination source.

FIG. 2A is an exemplary block diagram illustrating a controller 200 configured to provide programmable regulated driving current for an illumination source 214. The controller 200 includes a power supply 210 configured to provide driving current for the illumination source 214. The illumination source 214 can include a backlight source used in a LCD system such as, a LED backlight source used in a small LCD system. A current regulator 212 is coupled to the power supply 210 and the illumination source 214. The current regulator 212 is configured to provide a regulated driving current for the illumination source 214. The current regulator 212 can be a transistor, such as a metal-oxide semiconductor transistor. A current sensor 216 is coupled to the illumination source 214. The current sensor 216 is configured to measure the driving current flowing through the illumination source 214.

A comparator 218 is coupled to the current sensor 216. The comparator 218 is also coupled to a signal reference unit 224. The comparator 218 is configured to compare the operating driving current measured by the current sensor 216 and a reference signal (current or voltage) provided by the signal reference unit 224. Based on the comparison, the comparator 216 generates an error signal representing the difference between the operating driving current and the reference signal. A programmable interface unit 220 is configured to provide a digital reference representing the reference signal. The digital reference is converted into an analog signal by a digital-to-analog converter 222 coupled to the programmable interface unit 220. The signal reference unit 224 uses the analog signal generated by the digital-to-analog converter 222 and generates the reference signal.

The programmable interface unit 220 can include any programmable controller such as, for example, a microprocessor, a microcontroller, an application specific integrated circuit, a digital signal processor, and the like. A user can program the digital reference in the programmable interface unit 220 to provide a predetermined value of a reference driving current for the illumination source 214. Further, the programmable interface unit 220 can also be configured to modify the digital reference programmed by the user. For example, the programmable interface unit 220 can be programmed to monitor the environmental and operating conditions of the controller 200 and adjust the value of the digital reference accordingly. The comparator 218 uses the error signal to adjust an input bias for the current regulator 212. Based on the input bias, the current regulator 212 adjusts the operating driving current for the illumination source 214 accordingly.

Figure 2B:
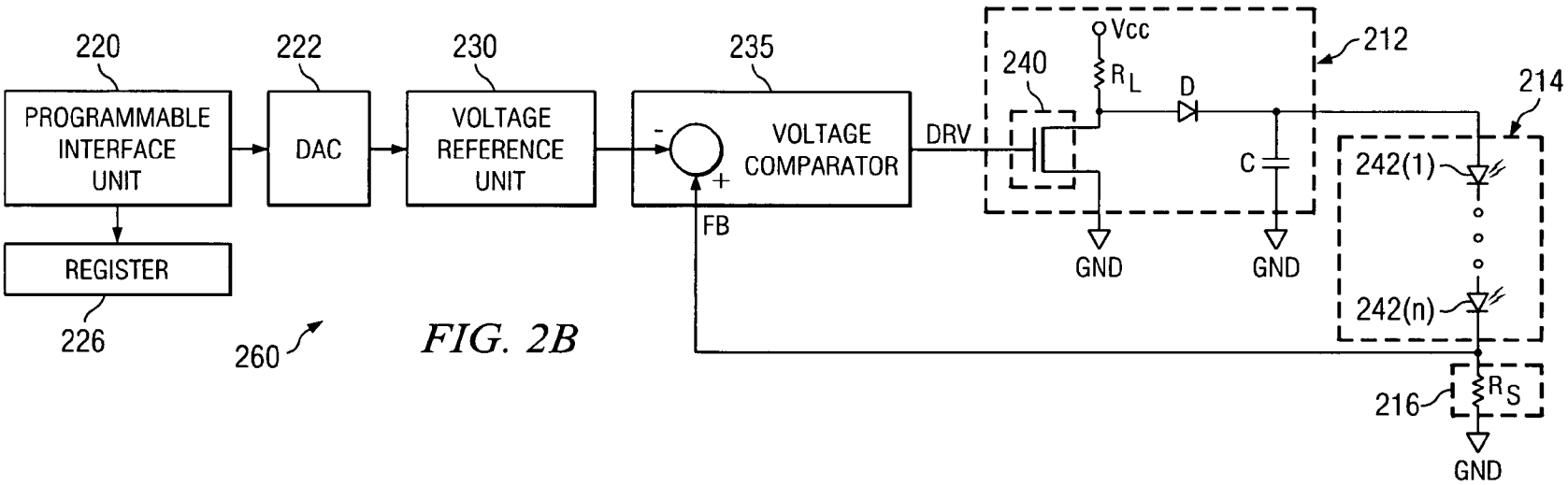
FIG. 2B is an exemplary schematic of a controller configured to provide programmable regulated driving current for an illumination source using a voltage comparator.

FIG. 2B is an exemplary schematic of a controller 260 configured to provide programmable regulated driving current for an illumination source 214 using a voltage comparator 235. The controller 260 includes a programmable interface unit 220. The programmable interface unit 220 is coupled to a register 226. The register 226 is a data storage unit configured to store functional parameters of the illumination source 214. For purposes of illustration, the register 226 is shown as a separate data storage unit; however, the register 226 can be integrated into the programmable interface unit 220.

The programmable interface unit 220 is coupled to a digital-to-analog converter 222. The digital-to-analog converter 222 converts digital reference data stored in the register 226 into a corresponding analog signal. A user can program the digital reference data into the register 226 via the programmable interface unit 220. The digital reference data represents a reference driving current for the illumination source 214. The digital reference data can be generated by simulating desired operating conditions for the illumination source 214. For example, if the brightness of the illumination source 214 is proportional to the driving current flowing through the illumination source 214, then a value of a preferred driving current corresponding to a desired brightness of the illumination source 214 can be determined by simulating the operating conditions of the illumination source 214 for the desired brightness. The value of the preferred driving current can then be converted into the digital reference data using an analog-to-digital converter and stored in the register 226.

The programmable interface unit 220 provides the digital reference data to the digital-to-analog converter 222. The digital-to-analog converter 222 converts the digital reference data into an analog signal and forwards the analog signal to a voltage reference unit 230. The voltage reference unit 230 is configured to generate a reference voltage signal corresponding to the analog signal. For purposes of illustration, the voltage reference unit 230 is shown as a separate unit; however, the voltage reference unit 230 can be integrated into the digital-to-analog converter 222. For example, the digital-to-analog converter 222 can be configured to convert the digital reference data into the reference voltage signal. A voltage comparator 235 is coupled to the voltage reference unit 230. The voltage comparator 235 is configured to compare two input voltages and generate a driving signal DRV corresponding to a difference between the input voltages.

A current regulator 212 is coupled to the voltage comparator 235. The current regulator 212 is further coupled to the illumination source 214. In the present example, the current regulator 212 includes a metal-oxide semiconductor (MOS) transistor 240. The MOS transistor 240 is configured to regulate the driving current for the illumination source 214. A gate terminal of the MOS transistor 240 is coupled to the voltage comparator 235 and receives the driving signal DRV. A source terminal of the MOS transistor 240 is grounded and a drain terminal of the MOS transistor 240 is coupled to a power source $V_{cc}$ via a resistor $R_L$. The drain terminal of the MOS transistor 240 is further coupled to the illumination source 214 via a diode D. The diode D is also coupled to the ground via a bypass capacitor C. The diode D is configured to protect the illumination source 214 against malfunctioning of the controller 260 and bypass any undesirable high frequency electric current to the ground via the bypass capacitor C.

In the present example, the illumination source 214 includes serially connected LEDs 242(1)–(*n*). LEDs 242(1)–(*n*) can be connected in series, parallel, or in a combination of serial and parallel arrangement. A sensor 216 is coupled to the illumination source 214. The sensor 216 includes a sensor resistor $R_S$. The sensor resistor $R_S$ is used to determine a voltage FB corresponding to the driving current flowing through the illumination source 214. The sensor resistor $R_S$ is coupled to one of the inputs of the voltage comparator 235. The voltage comparator 235 receives the voltage FB and compares it with the reference voltage signal received from the voltage reference unit 230 and generates the driving signal DRV for the gate terminal of the MOS transistor 240.

The driving signal DRV drives the gate terminal of the MOS transistor 240 according to the difference between the voltage FB and the reference voltage signal. Based on the driving signal DRV, the MOS transistor 240 adjusts the driving current for the illumination source 214. For example, if the driving current in the illumination source 214 is reduced due to certain operating and environmental conditions, then the difference between the voltage FB and the reference voltage signal generates a relatively stronger driving signal DRV, resulting in an increase in the driving current for the illumination source 214. Similarly, if the driving current through the illumination source 214 increases, then the voltage comparator 235 generates a relatively weaker driving signal DRV, resulting in a reduction in the driving current for the illumination source 214. The values of resistors $R_L$ and $R_S$ can be selected according to the desired driving current and corresponding brightness for the illumination source 214.

Figure 2C:
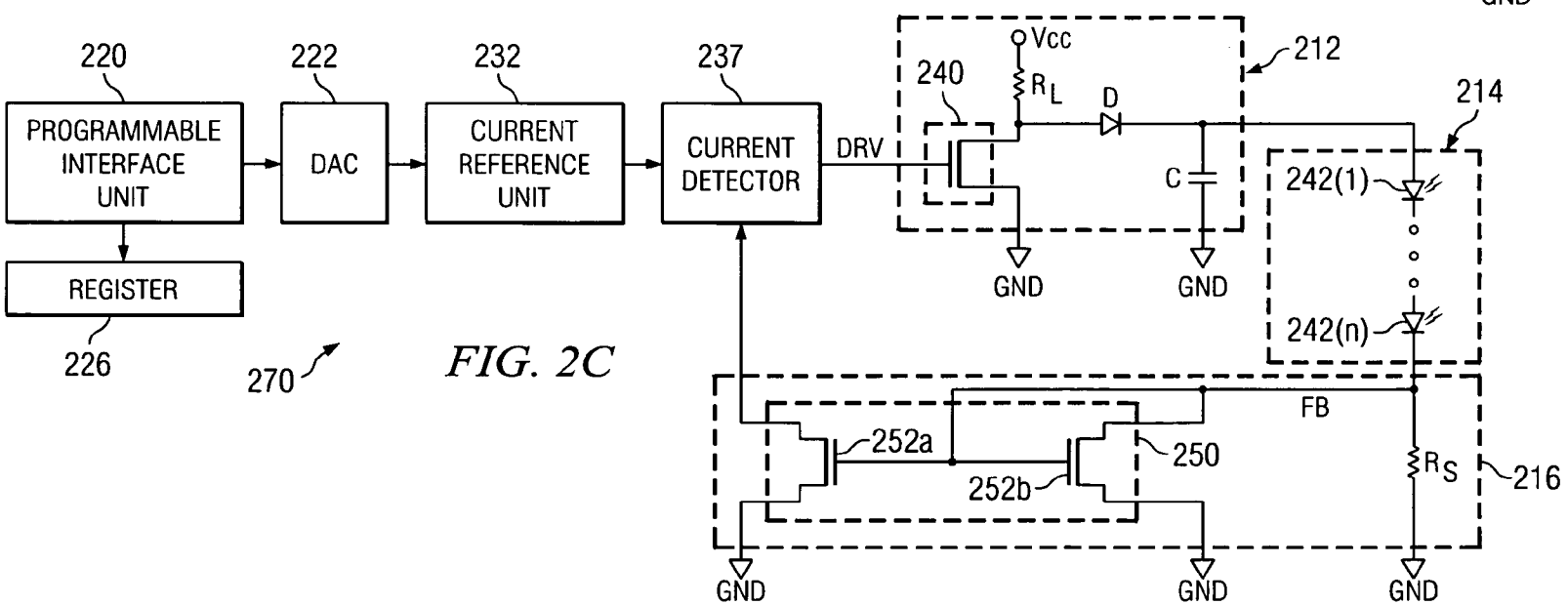
FIG. 2C is an exemplary schematic of a controller configured to provide programmable regulated driving current for an illumination source using a current detector.

FIG. 2C is an exemplary schematic of a controller 270 configured to provide a programmable regulated driving current for an illumination source 214 using a current detector 237. The controller 270 includes the programmable interface unit 220, the register 226, and the digital-to-analog converter 222. A current reference unit 232 is coupled to the digital-to-analog converter 222 and the current detector 237. The current reference unit 232 is configured to provide a reference current signal to a current detector 237. For purposes of illustration, the current reference unit 232 is shown as a separate unit; however, the current reference unit 232 can be integrated into the digital-to-analog converter 222. For example, the digital-to-analog converter 222 can be configured to convert the digital reference data into the reference current signal.

The current detector 237 is configured to detect a difference between the reference current and the driving current flowing through the illumination source 214 and generate a driving signal DRV for the current regulator 212. The function of the current detector 237 is known in the art. In the present example, the sensor 216 includes a sensor resistor $R_S$ and a pair of MOS transistors 252*a* and 252*b*. The gate terminals of the MOS transistors 252*a* and 252*b* are coupled together. The source terminals of the MOS transistors 252*a* and 252*b* are grounded. The drain terminal of the MOS transistor 252*b* is coupled to the gate terminal. The drain terminal of the MOS transistor 252*a* is coupled to the current detector 237.

When the driving current flowing through the illumination source 214 changes, the voltage FB across the sensor resistor $R_S$ also changes accordingly. The change in voltage FB causes a change in the gate bias for the MOS transistors 252*a* and 252*b*, which results in a corresponding change in the current flowing through the drain terminal of the MOS transistor 252*a*. When the current detector 237 detects a difference between the reference current signal and the current flowing through the MOS transistor 252*b*, the current detector 237 generates a driving signal DRV corresponding to the difference. The driving signal DRV adjusts the driving current of the current regulator 212 as described previously herein.

Figure 3A:
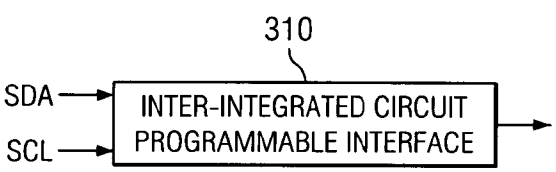
FIG. 3A illustrates an exemplary two-bit serial bus interface controller that can be used for a controller configured to provide programmable regulated driving current for an illumination source.

FIG. 3A illustrates an exemplary two-bit serial bus interface controller 310 that can be used for a controller configured to provide programmable regulated driving current for an illumination source. The controller 310 is an industry standard two-bit Inter-Integrated Circuit ($I^2C$) programmable serial bus interface. The controller 310 includes two bi-directional signal lines, Clock (SCL) and Data (SDA), for communicating with integrated circuit devices. The SCL signal line is used for serial clock and the SDA signal line is used for serial data. The $I^2C$ programmable serial bus interface can be used in an application that requires reduced number of pins for the controller. The $I^2C$ type controllers can provide a bus speed of up to 400 kHz.

Figure 3C:
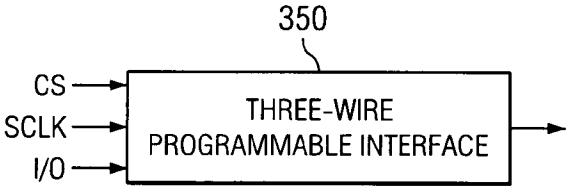
FIG. 3C illustrates an exemplary three-wire serial bus interface controller that can be used for a controller configured to provide programmable regulated driving current for an illumination source.
Figure 3B:
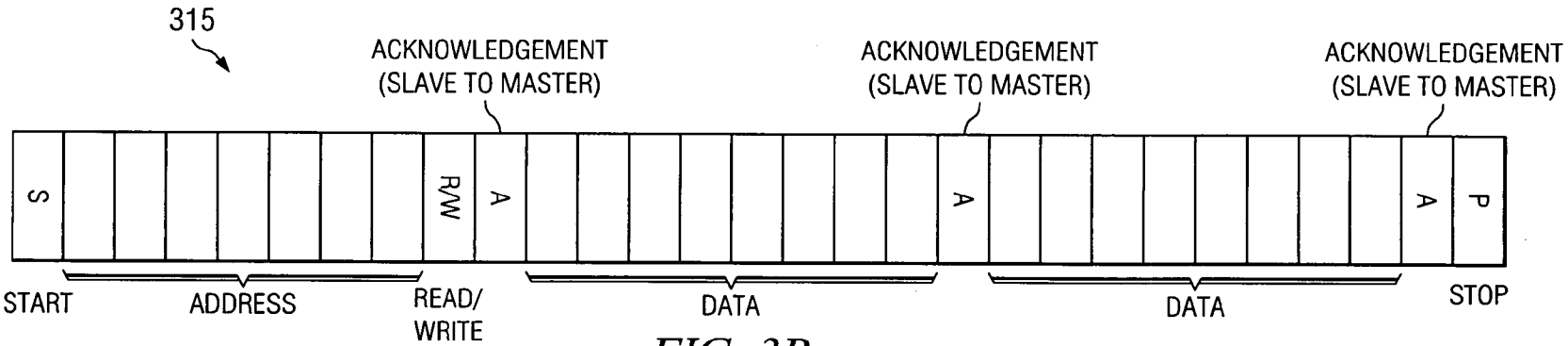
FIG. 3B illustrates an exemplary format of a data frame for the exemplary two-bit serial bus interface controller shown in FIG. 3A.

FIG. 3B illustrates an exemplary format of a typical data frame 315 for $I^2C$ two-bit serial bus interface controller shown in FIG. 3A. The $I^2C$ controller functions according to a master/slave relationship between various integrated devices. A master is a device that controls the SCL line, starts and stops the data transfer, and controls the addressing of other devices connected to the $I^2C$ controller. A slave is a device that is selected by the master. The typical data frame 315 includes one start bit S, seven address bits, one read/write bit, three acknowledgement bits A, two data bytes, and one stop bit P. Typically, a data-receiving device sets the acknowledgement bits to indicate the receipt of the data. Once the last bit of the 8-bit data has been transferred, an acknowledgement flag A is set to confirm that no error has occurred during the data transmission. The $I^2C$ controller transfers the data starting from the most significant bit to the least significant bit.

FIG. 3C illustrates an exemplary three-wire serial bus interface controller 350 that can be used for a programmable current controller configured to provide regulated driving current for an illumination source. The controller 350 is an industry standard three-wire serial bus interface controller. The controller 350 includes three bi-directional signal lines Clock (SCLK), Data In/Out (I/O), and Chip Select (CS). The CS signal line is used to select a particular device for communication, the I/O signal line is used for data/address transfer, and the SCLK signal line is used to synchronize the data transfer. The three-wire type controllers can provide a bus speed of up to 5 MHz.

Figure 3D:
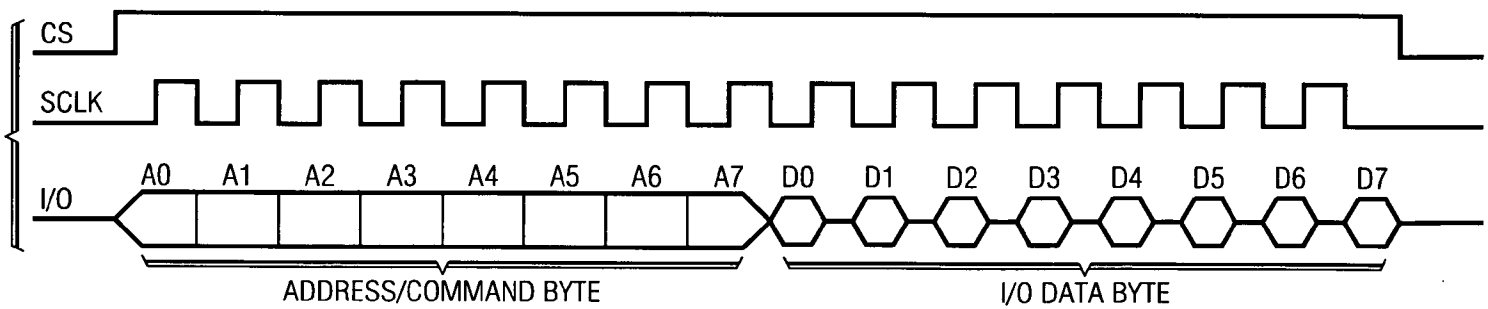
FIG. 3D illustrates a timing diagram for a single-byte data transfer protocol for the exemplary three-wire serial bus interface controller shown in FIG. 3C.

FIG. 3D illustrates a timing diagram for a single-byte data transfer protocol for the three-wire serial bus interface controller 350 shown in FIG. 3C. The data transfer in the controller 350 is controlled by the CS signal. The CS signal must be active high for all data transfers. At the beginning of any data transfer, the SCLK signal should be low. The data is clocked-in on the rising edge of the SCLK signal through the I/O signal line. The data is clocked-out on the falling edge of the SCLK signal. Similarly, a burst protocol can also be used for the controller 350 to transfer more than one byte in a single data transaction. In contrast to the $I^2C$ controller 310, the data transfer in the three-wire serial bus interface controller 350 is performed from the least significant bit to the most significant bit. While for purposes of illustration, two types of serial bus interfaces are described, one skilled in the art will appreciate that any bus interface controller (serial, parallel, or a combination of serial and parallel) can be used to program various devices for providing regulated driving current for illumination sources in display devices.

Figure 4:
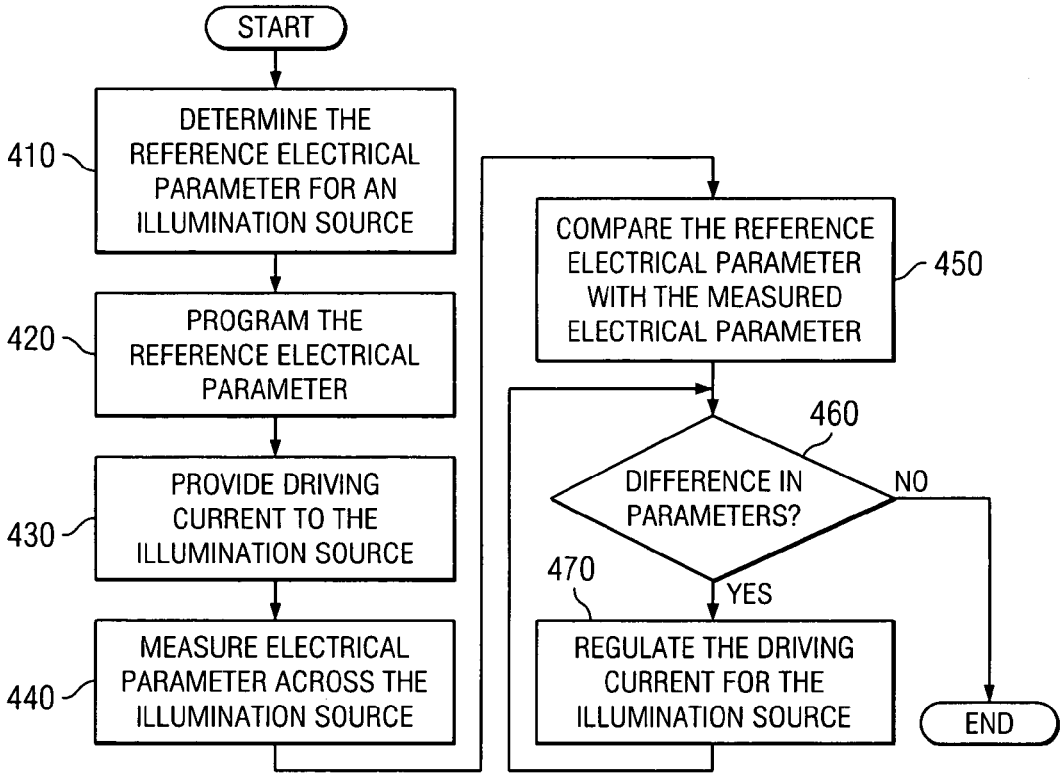
FIG. 4 is a flowchart illustrating exemplary steps performed during a process of regulating the driving current flowing through an illumination source.

FIG. 4 is a flowchart illustrating exemplary steps performed during a process of regulating the driving current flowing through an illumination source. For purposes of illustration, in the present example, various steps are described in a particular order; however, when accompanying with adequate circuit implementation, these steps can be performed in any order, serially or in parallel.

Initially, a reference electrical parameter (voltage or current) is determined for an illumination source (410). The reference electrical parameter represents a predetermined reference driving current for the illumination source. The type of the reference electrical parameter depends upon whether a voltage comparator or a current detector is used in a particular application. According to one embodiment, the reference electrical parameter can be determined by simulating a desired driving current flow through the illumination source. The reference electrical parameter is then converted into a digital reference using an analog-to-digital converter and programmed into a controller (420).

A driving current is then provided to the illumination source for normal operation (430). The electrical parameter (current or voltage) is then measured across the illumination source to determine the driving current flowing through the illumination source (440). The measured electrical parameter is then compared with the corresponding reference electrical parameter (450). The process then determines whether there is a difference between the measured electrical parameter and the reference electrical parameter (460). If there is a difference between the measured electrical parameter and the reference electrical parameter, then the driving current through the illumination source is regulated according to the difference (470).

The driving current flowing through the illumination device can be set at a substantially constant level by programming appropriate reference values for parameter comparison. The substantially constant driving current maintains the brightness of the illumination source and compensates for operating and environmental changes such as, for example, an increase in the operating temperature, a change in characteristic biases due to the prolonged use of circuit components, and the like. According to one embodiment, the programmable current controller described above can be integrated into a common integrated circuit to provide driving current controls for a backlight module of a LCD system. In another embodiment, the programmable current controller can be integrated into a source driver block of the LCD system.

Figure 5B:
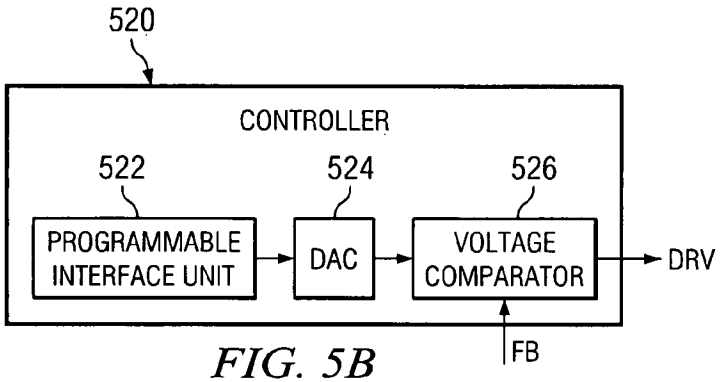
FIG. 5B is an exemplary schematic of a programmable controller integrated into a source driver block of the liquid crystal display system shown in FIG. 5A.
Figure 5A:
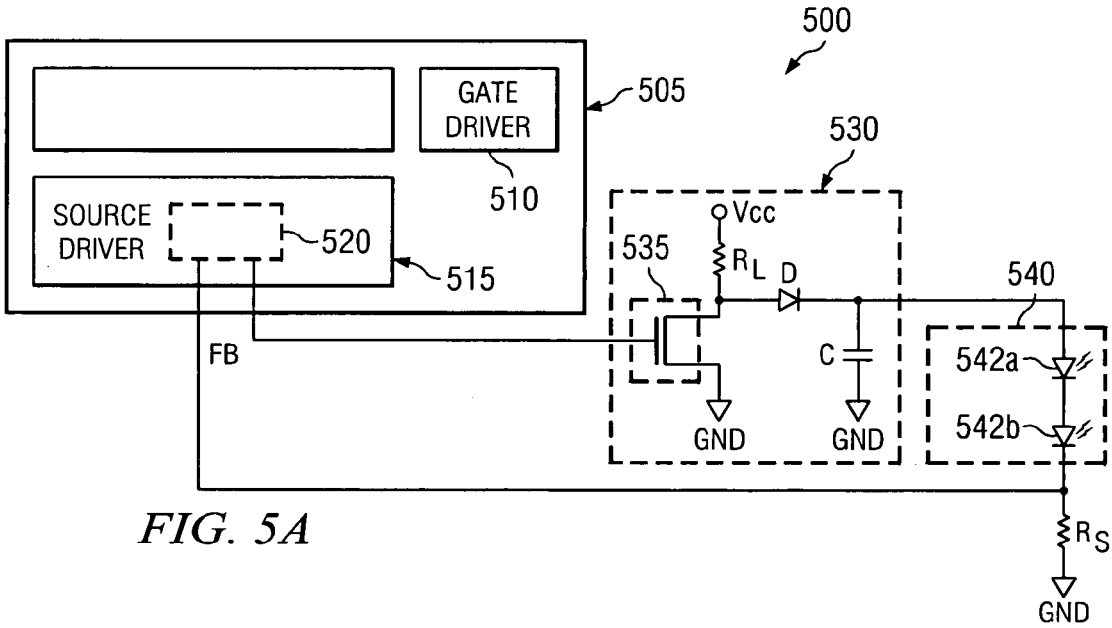
FIG. 5A illustrates an exemplary programmable driving current controller integrated into a source driver block of a liquid crystal display system.

FIG. 5A illustrates an exemplary implementation of a programmable driving current controller integrated into a source driver block of a LCD system 500. The LCD system 500 includes a LCD panel 505. The LCD panel 505 includes a gate driver 510 and a source driver 515. The gate driver 510 and the source driver 515 are configured to provide driving signals to rows and columns of the display panel 505. The source driver 515 includes a programmable driving current controller ("controller") 520. The controller 520 is coupled to a current regulator 530 and an illumination device 540. In the present example, the controller 520 is configured using a voltage comparator (not shown); however, the controller 520 can also be configured using a current detector as described previously herein. The voltage representing the driving current flowing through the illumination device is measured using a sensor resistor $R_s$. For purposes of illustration, the illumination source 540 is configured as a backlight module for the LCD panel 505 and includes two LEDs 542*a* and 542*b*. However, the illumination source 540 can include any number of LEDs, lamps, and similar other illumination devices. The current regulator 530 includes a MOS transistor 535, a load resistor $R_L$, a protection diode D, a voltage source $V_{cc}$, and a bypass capacitor C. The function of the current regulator 530 has been described previously herein.

FIG. 5B is an exemplary schematic of the controller 520 integrated in a source driver block 515 of the liquid crystal display system 500. The controller 520 includes a programmable interface unit 522, a digital-to-analog converter 524, and a voltage comparator 526. In the present example, the digital-to-analog converter 524 provides a reference voltage for the voltage comparator 526. The voltage comparator 526 compares the reference voltage from the digital-to-analog converter 524 and a voltage FB from the sensor resistor $R_s$. Based on the comparison, the voltage comparator 526 provides a driving bias signal DRV to the current regulator 530. Any change in the driving current through the illumination source 540 is reflected in the driving bias signal DRV, which adjusts the driving current for the illumination source 530 accordingly.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the exemplary configurations may be implemented as a combined structure or component. These and other variations, modifications, additions, and improvements may fall within the scope of the invention as defined in the claims that follow.

The section headings in this application are provided for consistency with the parts of an application suggested under 37 CFR 1.77 or otherwise to provide organizational cues. These headings shall not limit or characterize the invention(s) set out in any patent claims that may issue from this application. Specifically and by way of example, although the headings refer to a "Field of the Invention," the claims should not be limited by the language chosen under this heading to describe the so-called field of the invention. Further, a description of a technology in the "Description of Related Art" is not be construed as an admission that technology is prior art to the present application. Neither is the "Summary of the Invention" to be considered as a characterization of the invention(s) set forth in the claims to this application. Further, the reference in these headings to "Invention" in the singular should not be used to argue that there is a single point of novelty claimed in this application. Multiple inventions may be set forth according to the limitations of the multiple claims associated with this patent specification, and the claims accordingly define the invention(s) that are protected thereby. In all instances, the scope of the claims shall be considered on their own merits in light of the specification but should not be constrained by the headings included in this application.

What is claimed is:

1. A display system comprising:

a display panel having at least one illumination source; and a programmable current controller coupled to the at least one illumination source, wherein the programmable current controller is configured to regulate an operating driving current of the at least one illumination source according to a digital reference programmable by a user and corresponding to a predetermined reference driving current, the programmable current controller comprising:

a programmable interface configured to program the digital reference in a memory;

a digital-to-analog converter coupled to the programmable interface and configured to convert the digital reference into a first electrical parameter;

a comparator coupled to the programmable interface and configured to compare the first electrical parameter with a second electrical parameter corresponding to the operating driving current of the at least one illumination source, and generate a driving bias current; and a current regulator coupled to the comparator and configured to regulate the operating driving current of the at least one illumination source according to the driving bias current, wherein the driving bias current corresponds to a difference between the first and second electrical parameters.

2. A display system according to claim 1, wherein the programmable current controller further comprising:

a sensor coupled to the at least one illumination source and configured to measure the second electrical parameter.

3. A display system according to claim 1, wherein the sensor is a resistor.

4. A method of regulating an operating driving current for at least one illumination source of a display system comprising:

measuring a first electrical parameter corresponding to the operating driving current of the at least one illumination source;

converting a digital reference into a second electrical parameter, wherein the digital reference is programmable by a user and corresponds to a predetermined driving current for the at least one illumination source;

comparing the first electrical parameter with the second electrical parameter;

based on the comparison, generating a driving bias current; and regulating the operating driving current of the at least one illumination source according to the driving bias current.

5. A method according to claim 4, wherein the first electrical parameter is a feedback voltage corresponding to the operating driving current of the at least one illumination source; and the second electrical parameter is a voltage corresponding to the predetermined driving current for the at least one illumination source.

6. A method according to claim 4, wherein the first electrical parameter is a feedback current corresponding to the operating driving current of the at least one illumination source; and the second electrical parameter is a current corresponding to the predetermined driving current for the at least one illumination source.

7. A method according to claim 4, wherein the digital reference is stored in a memory.

8. A method according to claim 4, wherein the driving bias current corresponds to a difference between the first and second electrical parameters.

9. A method according to claim 4, wherein the display system is a liquid crystal display system.

10. A method according o claim 4, wherein the at least one illumination source includes at least one light-emitting diode.

11. A display system according to claim 1, wherein the programmable interface is an inter-integrated circuit serial interface.

12. A display system according to claim 1, wherein the programmable interface is three-wire serial interface.

13. A display system comprising:

a display panel having at least one illumination source;

a programmable interface configured to store a digital reference programmable by a user;

a digital-to-analog converter configured to convert the digital reference into a first electrical parameter;

a comparator configured to compare the first electrical parameter with a second electrical parameter corresponding to an operating driving current of the at least one illumination source, and generate a driving bias current; and a current regulator configured to regulate the operating driving current of the at least one illumination source according to the driving bias current, wherein the driving bias current corresponds to a difference between the first and second electrical parameters.

14. A display system according to claim 13, wherein the second electrical parameter is obtained by measurement of the operating driving current flowing through the illumination source.

15. A display system according to claim 13, wherein the programmable interface is an inter-integrated circuit serial interface.

16. A display system according to claim 13, wherein the programmable interface is three-wire serial interface.

* * * * *

UNITED STATES PATENT AND TRADEMARK OFFICE

CERTIFICATE OF CORRECTION

PATENT NO. : 7,057,359 B2
APPLICATION NO. : 10/695592
DATED : June 6, 2006
INVENTOR(S) : Hung et al.

It is certified that error appears in the above-identified patent and that said Letters Patent is hereby corrected as shown below:

Please delete inventor, item [75], Ghi-Mao Hung, and insert Chi- Mao Hung.

Signed and Sealed this

Twenty-sixth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,057,359 B2
APPLICATION NO. : 10/695592
DATED : June 6, 2006
INVENTOR(S) : Hung et al.

It is certified that error appears in the above-identified patent and that said Letters Patent is hereby corrected as shown below:

Please insert item [75], Chi-Mao Hung, and delete GHI-MAO HUNG.

Signed and Sealed this

Ninth Day of January, 2007

JON W. DUDAS
*Director of the United States Patent and Trademark Office*